US008046215B2

(12) United States Patent
Cho

(10) Patent No.: US 8,046,215 B2
(45) Date of Patent: Oct. 25, 2011

(54) METHOD AND APPARATUS TO DETECT VOICE ACTIVITY BY ADDING A RANDOM SIGNAL

(75) Inventor: Jae-youn Cho, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 701 days.

(21) Appl. No.: 12/126,110

(22) Filed: May 23, 2008

(65) Prior Publication Data

US 2009/0125304 A1 May 14, 2009

(30) Foreign Application Priority Data

Nov. 13, 2007 (KR) ..... 10-2007-0115501

(51) Int. Cl.
*G10L 11/02* (2006.01)

(52) U.S. Cl. ..... 704/215; 704/213; 704/226

(58) Field of Classification Search ..... 704/208, 704/210, 213, 214, 215, 226, 238
See application file for complete search history.

(56) References Cited

U.S. PATENT DOCUMENTS

| | | | | |
|---|---|---|---|---|
| 5,159,638 | A * | 10/1992 | Naito et al. | 704/213 |
| 5,295,223 | A * | 3/1994 | Saito | 704/214 |
| 5,991,718 | A * | 11/1999 | Malah | 704/233 |
| 6,349,278 | B1 | 2/2002 | Krasny et al. | |
| 6,453,285 | B1 * | 9/2002 | Anderson et al. | 704/210 |
| 6,560,332 | B1 * | 5/2003 | Christensson et al. | 379/406.05 |
| 6,597,787 | B1 * | 7/2003 | Lindgren et al. | 379/406.05 |
| 6,691,085 | B1 * | 2/2004 | Rotola-Pukkila et al. | 704/228 |
| 6,993,481 | B2 * | 1/2006 | Skoglund et al. | 704/233 |
| 7,376,558 | B2 * | 5/2008 | Gemello et al. | 704/226 |
| 7,447,279 | B2 * | 11/2008 | Wilson | 375/340 |
| 7,653,536 | B2 * | 1/2010 | Tackin et al. | 704/214 |
| 2002/0054685 | A1 * | 5/2002 | Avendano et al. | 381/66 |
| 2003/0179888 | A1 * | 9/2003 | Burnett et al. | 381/71.8 |
| 2004/0068399 | A1 * | 4/2004 | Ding | 704/200.1 |
| 2006/0069551 | A1 * | 3/2006 | Chen et al. | 704/214 |
| 2006/0277038 | A1 * | 12/2006 | Vos et al. | 704/219 |
| 2007/0055508 | A1 * | 3/2007 | Zhao et al. | 704/226 |
| 2008/0162151 | A1 * | 7/2008 | Cho | 704/503 |
| 2009/0125305 | A1 * | 5/2009 | Cho | 704/233 |

FOREIGN PATENT DOCUMENTS

| | | |
|---|---|---|
| KR | 2001-73377 | 8/2001 |
| KR | 1020040047428 A | 6/2004 |

OTHER PUBLICATIONS

International Search Report issued Nov. 21, 2008 in International Application No. PCT/KR2008/003231.
Ahmad et al. "An isolated speech endpoint detector using multiple speech features", TENCON 2004, Nov. 21, 2004, vol. 2, pp. 403-406.
Qiang et al. "On Prefiltering and Endpoint Detection of Speech Signal", Proceedings of ICSP 1998, Oct. 12, 1998, vol. 1, pp. 749-752.

* cited by examiner

*Primary Examiner* — Martin Lerner
(74) *Attorney, Agent, or Firm* — Stanzione & Kim, LLP

(57) ABSTRACT

A method and apparatus to detect voice activity by using a zero-crossing rate includes removing noise included in an audio signal, adding a random signal having energy of a predetermined size to the audio signal from which noise is removed, extracting predetermined voice detection parameters from the audio signal to which the random signal is added, and comparing the extracted predetermined voice detection parameters with a threshold value and determining voice and non-voice activities.

17 Claims, 6 Drawing Sheets

METHOD AND APPARATUS TO DETECT VOICE ACTIVITY BY ADDING A RANDOM SIGNAL

CROSS-REFERENCE TO RELATED APPLICATIONS

This application claims priority under 35 U.S.C. §119(a) of Korean Patent Application No. 10-2007-0115501, filed on Nov. 13, 2007, in the Korean Intellectual Property Office, the disclosure of which is incorporated herein in its entirety by reference.

BACKGROUND OF THE INVENTION

1. Field of the Invention

The present general inventive concept relates to an audio processing system, and more particularly, to a method and apparatus to detect voice activity by using a zero-crossing rate.

2. Description of the Related Art

In general, Voice Activity Detection (VAD) or End Point Detection (EPD) is used as a method of extracting voice activity from speech coding or speech recognition. In a conventional method of detecting voice activity, voice activity or a starting point and an end point of a voice signal are detected by using the energy of a frame and a zero-crossing rate of a frame. For example, the voice activity of a frame is determined when its zero-crossing rate is low, and non-voice activity of a frame is determined when its zero-crossing rate is high.

Here, since some types of noise or null signal lower the zero-crossing rates, zero-crossing rates for voice activity may not be distinctive from those for non-voice activity.

In other words, even though voice activity is detected using a zero-crossing rate in a conventional method, the detection may be false when some types of noise are added or there is no signal at all.

SUMMARY OF THE INVENTION

The present general inventive concept provides a method and apparatus to detect voice activity which enables the robust detection of voice activity that lessens the drawback of using zero-crossing rate.

The present general inventive concept also provides an audio processing device employing an apparatus to detect voice activity.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of detecting voice activity, the method including adding a random signal having energy of a predetermined size to an audio signal, extracting predetermined voice detection parameters from the audio signal to which the random signal is added, and comparing the extracted predetermined voice detection parameters with a threshold value and determining voice and non-voice activities.

The audio signal may have stationary or non-stationary noise.

The random signal may have a zero-crossing rate that is larger than a standard value.

The random signal may be white Gaussian noise having a normal distribution.

The predetermined voice detection parameters may include frame power.

The method may further include removing a noise from an input audio signal to generate a noise removed signal as the audio signal.

The removing of the noise may include predicting noise properties of the audio signal, and subtracting the predicted noise properties from the audio signal and removing noise from the audio signal.

The foregoing and/or other aspects and utilities of the present general inventive concept may also be achieved by providing an apparatus to detect voice activity, the apparatus including a noise removal unit which removes noise included in an audio signal, a random signal generator which generates a random noise signal having energy of a determined size, an addition unit which adds the random signal generated by the random signal generator to the audio signal from which noise is removed by the noise removal unit, a voice determination parameter extracting unit which extracts predetermined voice detection parameters from the audio signal to which the random signal is added by the addition unit, and a voice determination unit which detects voice and non-voice activities by using the voice detection parameters extracted by the voice determination parameter extracting unit.

The apparatus may further include a noise removal unit which removes noise included in an input audio signal to generate the noise removed signal as the audio signal.

The random signal generator may generate an energy corresponding to the non-voice activity as the random signal.

The random signal generator may generate an energy varying to correspond to a characteristic of the audio signal as the random signal.

The adding unit may selectively add the random signal to the audio signal according to a character of the audio signal.

The foregoing and/or other aspects and utilities of the present general inventive concept may also be achieved by providing an audio processing device including a voice activity detector which adds a random signal having energy of a determined size to the an audio signal to extract one or more predetermined voice detection parameters and compares the extracted predetermined voice detection parameters with a threshold value to determine voice and non-voice activities, and an audio signal processing unit which performs voice coding and a voice recognizing process according to information about voice and non-voice activities detected by the voice activity detector.

The foregoing and/or other aspects and utilities of the present general inventive concept may also be achieved by providing a computer readable recording medium having embodied thereon a computer program for executing a method of detecting voice activity including removing noise included in an audio signal, adding a random signal having energy of a predetermined size to the audio signal from which noise is removed, extracting predetermined voice detection parameters from the audio signal to which the random signal is added, and comparing the extracted predetermined voice detection parameters with a threshold value and determining voice and non-voice activities.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

Figure 1A:
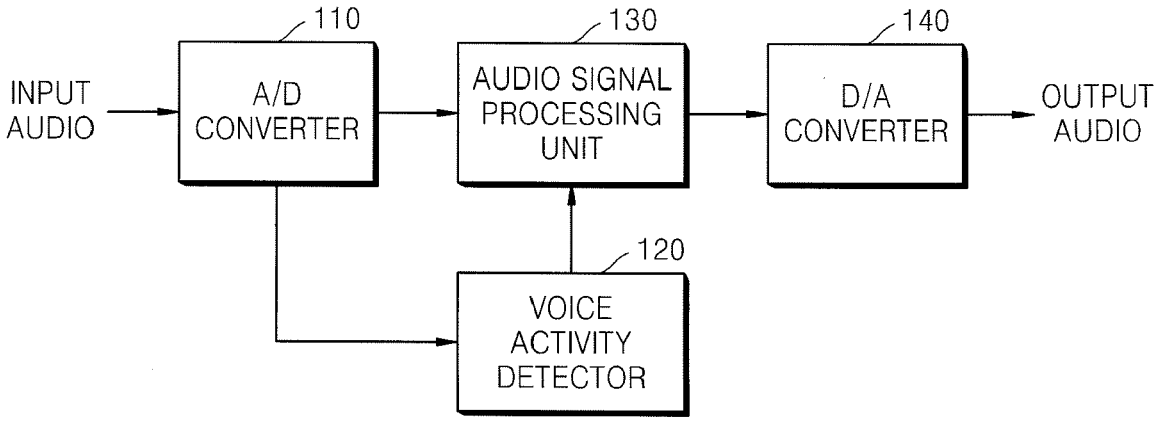
FIGS. 1A and 1B are block diagrams illustrating respective audio processing systems including a function of detecting voice activity, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 1B:
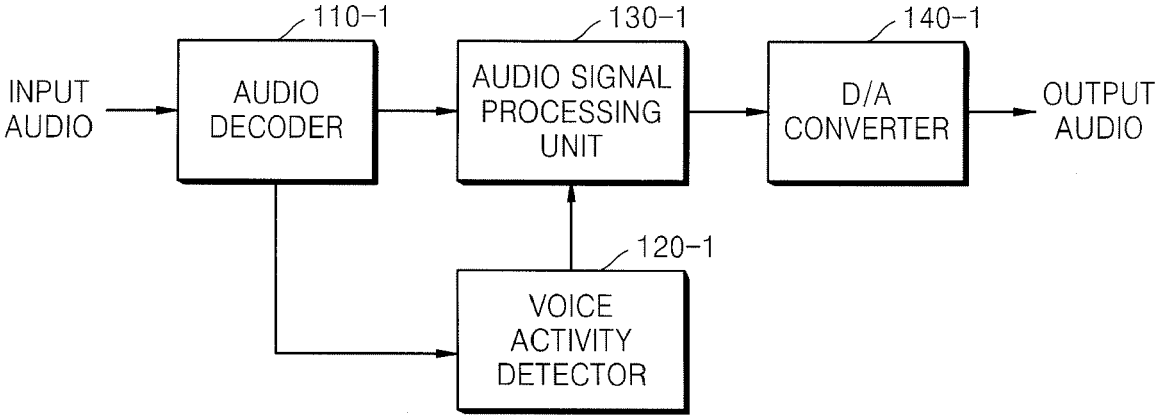

FIGS. 1A and 1B illustrate respective audio processing systems including a function of detecting voice activity, according to an embodiment of the present general inventive concept.

FIG. 1A illustrates an audio processing system when an analog audio signal is input thereto.

The audio processing system of FIG. 1A includes an Analog/Digital (A/D) converter 110, a voice activity detector 120, an audio signal processing unit 130, and a Digital/Analog (D/A) converter 140.

The A/D converter 110 converts an analog audio signal into a digital audio signal.

The voice activity detector 120 adds a random signal having energy of a determined level to the audio signal output from the A/D converter 110, extracts one or more determined voice detection parameters, such as a zero-crossing rate of a frame or the power of a frame, from the audio signal to which the random signal is added, and compares the extracted voice detection parameters with a threshold value to determine voice and non-voice activities.

Here, the random signal may be an energy corresponding to a predetermined noise level. It is possible that the random signal may be a signal having a predetermined voltage, and the predetermined voltage may have amplitude in positive and/or negative directions with respect to a reference. The random signal may be a variable energy signal to correspond to an energy level of the audio signal, and thus the random signal varies according to the energy level of the audio signal. The random signal may be selectively applied or added to the audio signal according to a characteristic of the audio signal, e.g., a level, amount, amplitude of the audio signal.

The zero-crossing rate may be a rate or a ratio of changing a level of an audio signal. The zero-crossing rate is changed between voice activities and non-voice activities. According to the addition of the random signal to the audio signal, the zero-crossing rate according to the present embodiment can show a difference between boundaries of the voice activities and corresponding non-voice activities.

The audio signal processing unit 130 performs voice coding and a voice recognizing process according to information about voice and non-voice activities detected from the voice activity detector 120.

The D/A converter 140 converts the audio signal processed in the audio signal processing unit 130 into an analog audio signal.

FIG. 1B illustrates an audio processing system when a digital audio signal is input thereto.

The audio processing system of FIG. 1B includes an audio decoder 110-1, a voice activity detector 120-1, an audio signal processing unit 130-1, and a D/A converter 140-1.

The audio decoder 110-1 restores digital audio data according to a predetermined decoding algorithm.

Functions of the voice activity detector 120-1, the audio signal processing unit 130-1, and the D/A converter 140-1 are respectively the same as those of the voice activity detector 120, the audio signal processing unit 130, and the D/A converter 140 of FIG. 1A.

Figure 2A:
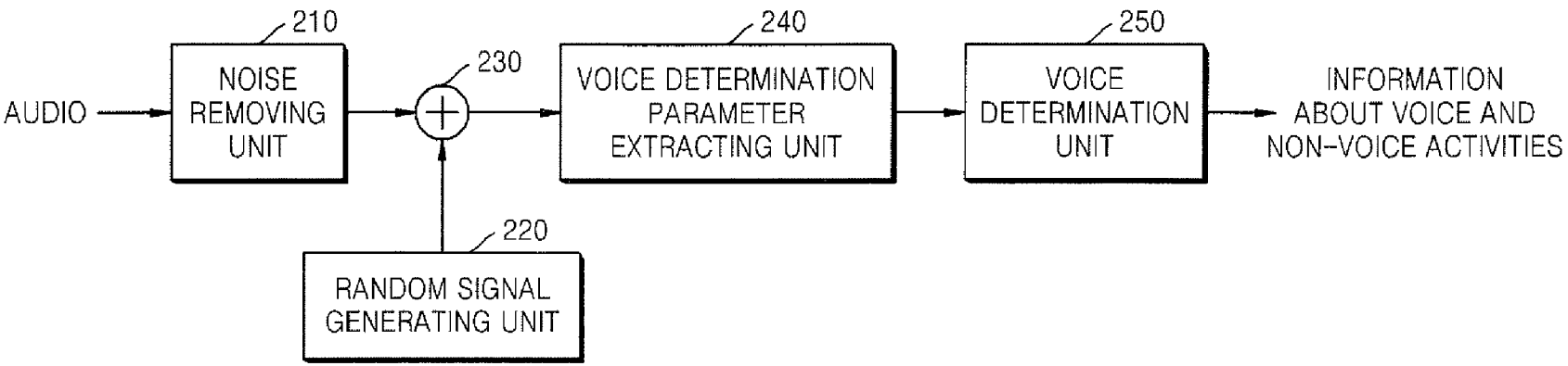
FIG. 2A is a detailed block diagram illustrating a voice activity detector of the audio processing system of FIGS. 1A and 1B.

FIG. 2A is a detailed block diagram illustrating the voice activity detectors 120 and 120-1 of FIGS. 1A and 1B.

The voice activity detector of FIG. 2A includes a noise removal unit 210, a random signal generator 220, an addition unit 230, a voice determination parameter extracting unit 240, and a voice determination unit 250.

In order to accurately extract a zero-crossing rate, the noise removal unit 210 removes stationary noise included in an audio signal. For example, the noise removal unit 210 removes stationary noise by using a spectral subtraction filter, a Weiner filter or other noise reduction filter.

The random signal generator 220 generates a random noise signal having energy of a predetermined size (level or amount) that is not harsh to the ears. It is possible that the random signal may be white Gaussian noise having a normal distribution or may have higher zero-crossing rate than that of speech signal.

The addition unit 230 adds the random signal generated by the random signal generator 220 to the audio signal from which the stationary noise is removed by the noise removal unit 210.

Ultimately, when noise is removed from an audio signal, a zero-crossing rate of non-voice activity may be close to "0." Accordingly, since a random noise is added to an audio signal, identification of non-voice activity can be improved by an improved zero-crossing rate.

The voice determination parameter extracting unit 240 extracts one or more predetermined voice detection parameters from the audio signal to which the random signal is added by the addition unit 230.

It is possible that the predetermined voice detection parameters may be a zero-crossing rate (ZCR), frame power, and a Line Spectrum Frequency (LSF). The zero-crossing rate refers to a frequency of code conversions of samples in a frame and the LSF refers to frequency properties of signals.

The voice determination unit 250 extracts voice and non-voice activities using voice detection parameters such as ZCR and LSF extracted from the voice determination parameter extracting unit 240.

For example, when the ZCR is less than a threshold value, the voice determination unit 250 determines a frame as voice activity and when the ZCR is greater than the threshold value, the voice determination unit 250 determines a frame as non-voice activity.

Figure 2B:
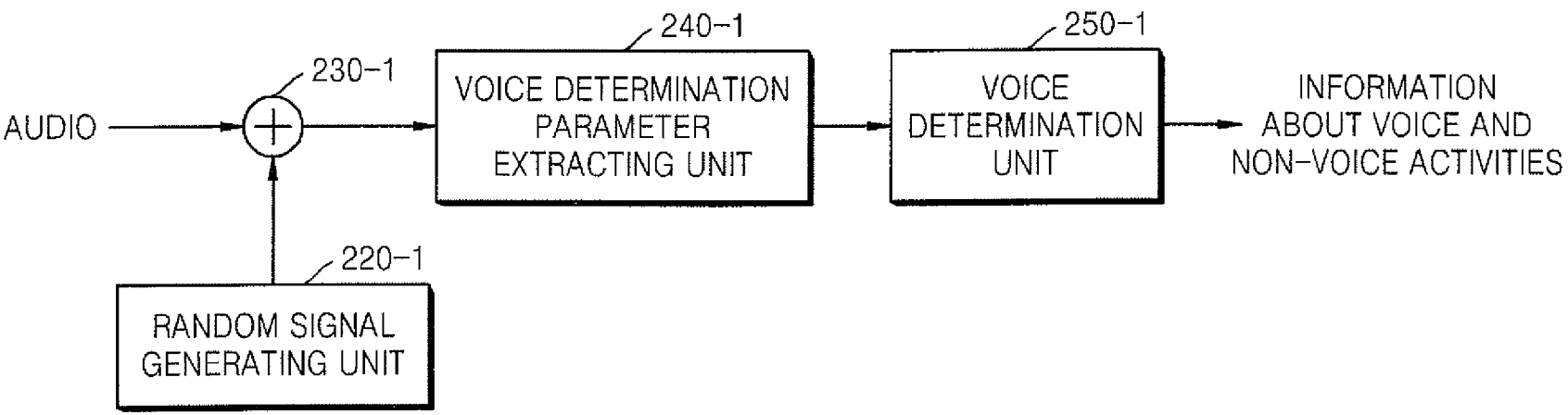
FIG. 2B is a detailed block diagram illustrating a voice activity detector of the audio processing system of FIGS. 1A and 1B.

FIG. 2B is a detailed block diagram illustrating the voice activity detectors 120 and 120-1 of FIGS.

The voice activity detector of FIG. 2B includes a random signal generator 220-1, an addition unit 230-1, a voice determination parameter extracting unit 240-1, and a voice determination unit 250-1.

The addition unit 230-1 adds the random signal generated by the random signal generator 220-1 to the audio signal.

Functions of a random signal generator 220-1, an addition unit 230-1, a voice determination parameter extracting unit 240-1, and a voice determination unit 250-1 are respectively the same as those of the random signal generator 220, the addition unit 230, the voice determination parameter extracting unit 240, and the voice determination unit 250.

Figure 3:
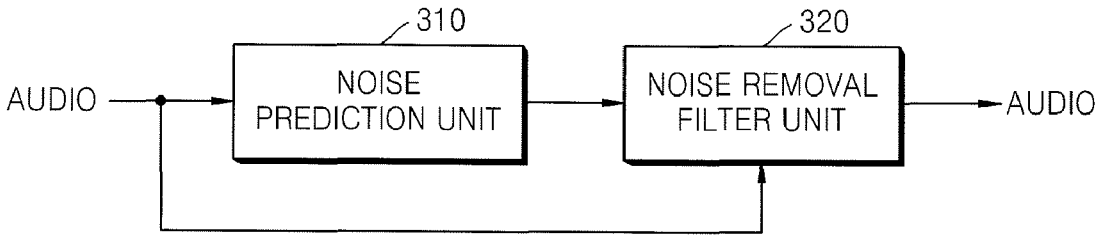
FIG. 3 is a block diagram illustrating a noise removal unit of the voice activity detector of FIG. 2.

FIG. 3 is a block diagram illustrating the noise removal unit 210 of FIG. 2A.

The noise removal unit 210 includes a noise prediction unit 310 and noise removal filter unit 320.

The noise prediction unit 310 predicts noise properties from an input audio signal. As an example of predicting noise, input frame power is firstly compared with a determined threshold value. Here, when the input frame power is less than the determined threshold value, the input frame is predicted as noise and a property value (for example, a spectrum) of the input frame is predicted as a noise property.

The noise removal filter unit 320 subtracts the noise property value predicted by the noise prediction unit 310 from the audio signal so as to remove noise from the input audio signal.

Figure 4:
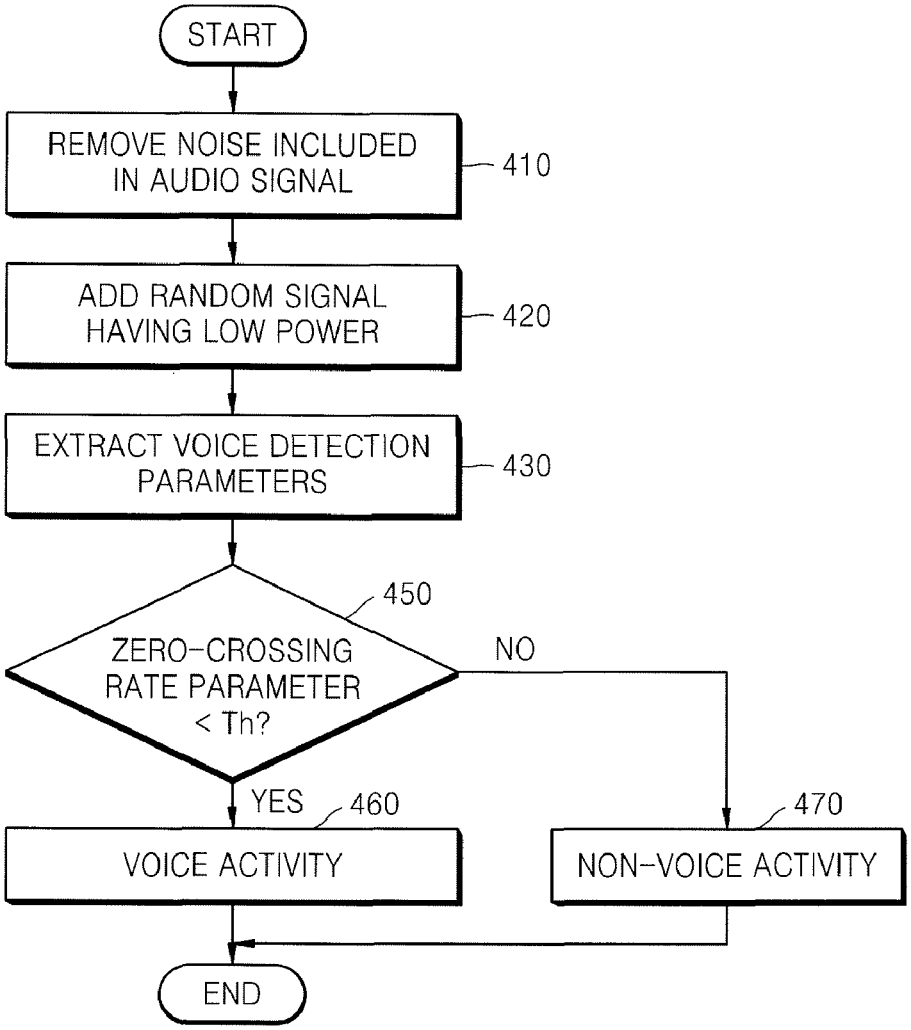
FIG. 4 is a flowchart illustrating a method of detecting voice activity according to an embodiment of the present general inventive concept.

FIG. 4 is a flowchart illustrating a method of detecting voice activity according to an embodiment of the present general inventive concept.

Referring to FIG. 4, one or more audio signals are input in units of frames.

Here, the level of noise is generally different in each input audio signal.

Accordingly, regardless of the level of noise, stationary noise included in the audio signals is removed in order to perform regular voice activity identification, in operation 410.

For example, stationary noise included in the audio signals is removed using a Wiener filter or a spectral subtraction filter.

Then, a random noise signal having energy with a determined size that is not harsh to the ears is added to the audio signals from which stationary noise is removed, in operation 420. In addition, the random noise signal has a zero-crossing rate that is larger than a standard value, in order to improve identification (detection) of voice/non-voice activities.

Voice detection parameters, such as a zero-crossing rate of a frame or the power of a frame, is then extracted from the audio signals to which the random signal is added, in operation 430. For example, the zero-crossing rate of a frame is obtained by dividing a frequency of code conversions of samples in a frame by the number of the samples. The frame power is obtained by dividing the sum of square sizes of the samples in a frame by the number of the samples.

Then, the extracted voice detection parameters are compared with a predetermined threshold value in operation 450.

Here, when the voice detection parameters are less than the predetermined threshold value, a current frame is determined as voice activity in operation 460. When the voice detection parameters are greater than the predetermined threshold value, a current frame is determined as non-voice activity in operation 470.

For example, when the zero-crossing rate of a frame is less than the predetermined threshold value, a current frame is determined as voice activity and when the zero-crossing rate of a frame is greater than the predetermined threshold value, a current frame is determined as non-voice activity.

Also, when the frame power is greater than the predetermined threshold, a current frame is determined as voice activity and when the frame power is less than the predetermined threshold, a current frame is determined as non-voice activity.

Accordingly, voice and non-voice activities are determined according to the comparison between the voice detection parameters and the predetermined threshold value and thus detection of voice activity of one frame is completed.

Figure 5A:
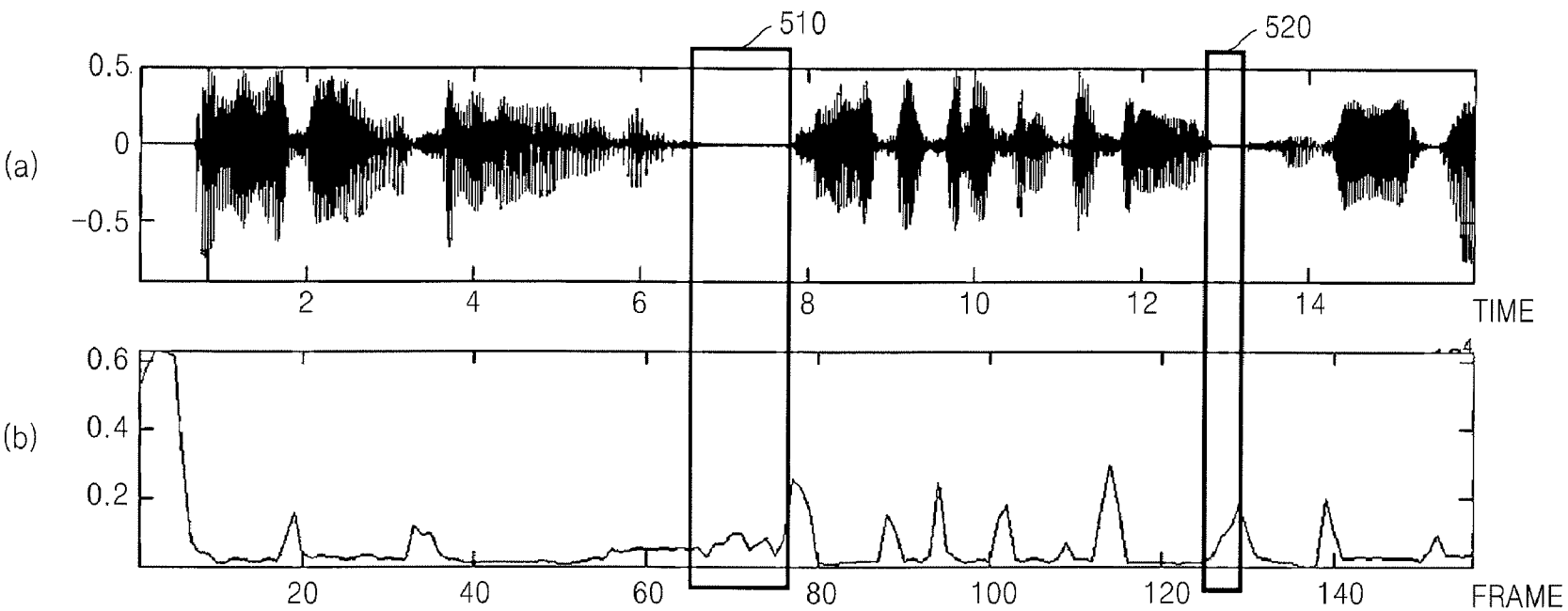
FIGS. 5A and 5B are graphs illustrating an audio signal and a zero-crossing rate for detecting voice activity according to an embodiment of the present general inventive concept.
Figure 5B:
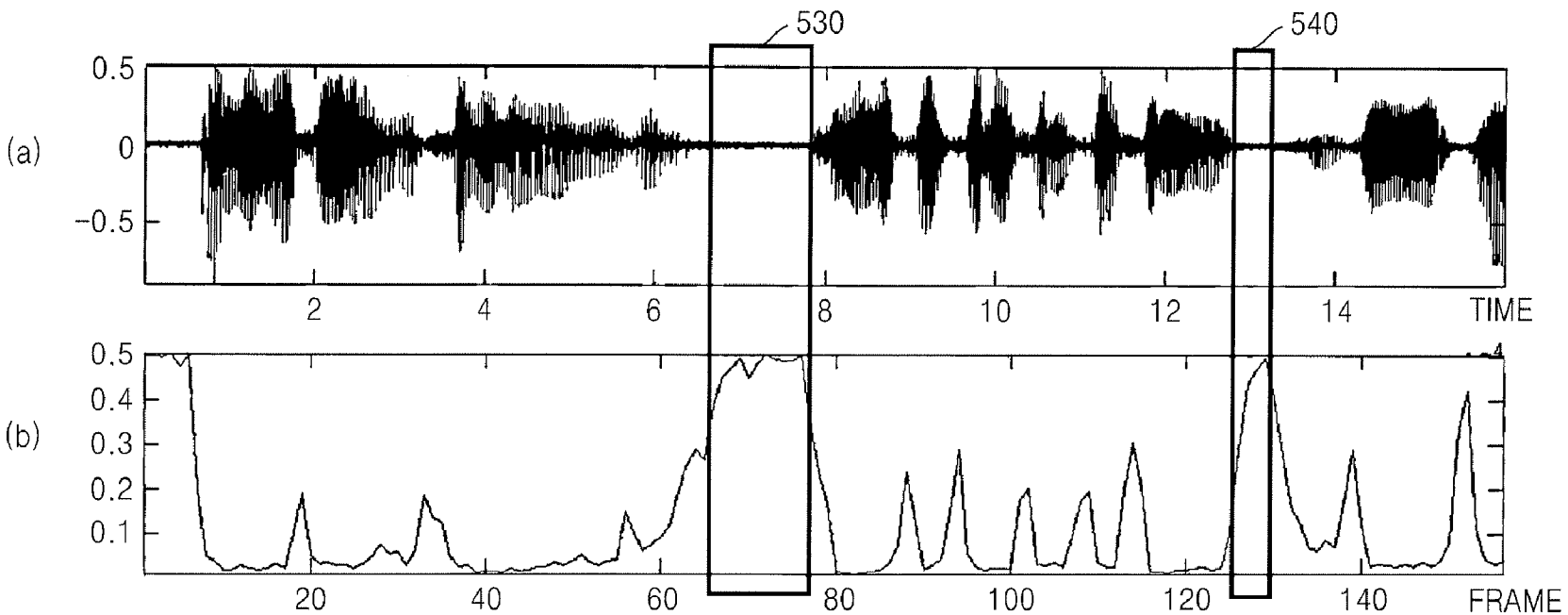

FIGS. 5A and 5B are graphs illustrating an audio signal and a zero-crossing rate for detecting voice activity according to an embodiment of the present invention.

FIG. 5A illustrates a graph (a) of plots of a general audio signal and a graph (b) of a zero-crossing rate of the audio signal. In the graph (a), an x-coordinate indicates time and a y-coordinate indicates size. In the graph (b), an x-coordinate indicates an order of a frame and a y-coordinate indicates a zero-crossing rate.

Referring to FIG. 5A, in general, due to a strong low frequency signal component, the zero-crossing rate is less in voice activity. In non-activities 510 and 520, the zero-crossing rate is greater due to unknown signal components, for example, background noise. However, when abnormal circumstances which may generate complete non-activity or may include direct current components in a microphone are generated, the zero-crossing rate may appear less. Accordingly, in plots of a general audio signal, non-activity cannot be identified.

FIG. 5B illustrates a graph (a) of plots of an audio signal to which a random signal having a small amount of energy is added and a graph (b) of a zero-crossing rate of the audio signal. In graph (a), an x-coordinate indicates time and a y-coordinate indicates size. In graph (b), an x-coordinate indicates an order of a frame and a y-coordinate indicates a zero-crossing rate.

Referring to FIG. 5B, when the random signal having a small amount of energy is added to the audio signal according to the present embodiment, a high zero-crossing rate appears in non-voice activities 530 and 540. Accordingly, when the zero-crossing rate that is greater than a threshold value appears, it is determined as non-voice activity and when the zero-crossing rate that is less than the threshold value appears, it is determined as voice activity.

Ultimately, voice and non-voice activities can be easily identified using a zero-crossing rate for the random signal in Voice Activity Detection (VAD) or End Point Detection (EPD).

According to the present general inventive concept, artificial random noise is added to an audio signal so as to obtain a zero-crossing rate and identification of voice and non-voice activities can be improved.

In addition, a zero-crossing rate due to random noise can be used in VAD or EPD.

Moreover, a noise removal algorithm is applied to an audio signal before obtaining a zero-crossing rate so that a VAD or EPD system that is for storing noise can be established.

The invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, hard disks, floppy disks, flash memory, optical data storage devices, and carrier waves (such as data transmission through the Internet). The computer readable recording medium can also be distributed over network coupled computer systems so that the computer readable code is stored and executed in a distributed fashion.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A method of detecting voice activity, the method comprising:

adding, using a processor, a random signal having energy of a predetermined size to an audio signal;

extracting one or more predetermined voice detection parameters from the audio signal to which the random signal is added; and comparing the extracted predetermined voice detection parameters with a threshold value and determining voice and non-voice activities of the audio signal.

2. The method of claim 1, wherein the audio signal has stationary noise or non-stationary noise.

3. The method of claim 1, wherein the random signal has a zero-crossing rate that is larger than a standard value.

4. The method of claim 1, wherein the predetermined voice detection parameters comprise a zero-crossing rate of a frame.

5. The method of claim 1, wherein the predetermined voice detection parameters comprise frame power.

6. The method of claim 1, further comprising;

removing a noise from an input audio signal to generate a noise removed signal as the audio signal.

7. The method of claim 6, wherein the removing of the noise comprises:

predicting noise properties of the audio signal; and subtracting the predicted noise properties from the audio signal and removing noise from the audio signal.

8. The method of claim 6, wherein the noise corresponds to the voice activity of the audio signal.

9. An apparatus to detect voice activity, comprising:

a random signal generator included in a processor, which generates a random noise signal having energy of a determined size;

an addition unit which adds the random signal generated by random signal generator to the audio signal;

a voice determination parameter extracting unit which extracts predetermined voice detection parameters from the audio signal to which the random signal is added by the addition unit; and a voice determination unit which detects voice and non-voice activities by using the voice detection parameters extracted by the voice determination parameter extracting unit.

10. The apparatus of claim 9, wherein the noise removal unit comprises:

a noise prediction unit which compares power of an audio frame with a predetermined threshold value and predicts noise properties of the audio signal; and a noise removal filter unit which subtracts noise properties predicted by the noise prediction unit from the audio signal and removes noise from the audio signal.

11. The apparatus of claim 9, further comprising:

a noise removal unit which removes noise included in an input audio signal to generate the noise removed signal as the audio signal.

12. The apparatus of claim 9, wherein the random signal generator generates an energy corresponding to the non-voice activity as the random signal.

13. The apparatus of claim 9, wherein the random signal generator generates an energy varying to correspond to a characteristic of the audio signal as the random signal.

14. The apparatus of claim 9, wherein the adding unit selectively adds the random signal to the audio signal according to a character of the audio signal.

15. An audio processing device comprising:

a voice activity detector which adds a random signal having energy of a determined size to an audio signal to extract one or more predetermined voice detection parameters and compares the extracted predetermined voice detection parameters with a threshold value to determine voice and non-voice activities; and an audio signal processing unit which performs voice coding and a voice recognizing process according to information about voice and non-voice activities detected by the voice activity detector.

16. A non-transitory computer readable recording medium having embodied thereon a computer program for executing a method of detecting voice activity comprising:

adding a random signal having energy of a predetermined size to an audio signal;

extracting predetermined voice detection parameters from the audio signal to which the random signal is added; and comparing the extracted predetermined voice detection parameters with a threshold value and determining voice and non-voice activities.

17. The computer readable recording medium of claim 16, wherein the method further comprises removing noise included in an input audio signal to generate the noise removed signal as the audio signal.

* * * * *